US010577176B2

(12) United States Patent
Jorgensen et al.

(10) Patent No.: US 10,577,176 B2
(45) Date of Patent: Mar. 3, 2020

(54) CORRUGATED STEEL FLOOR IN A SHIPPING CONTAINER

(71) Applicant: Maersk Container Industry A/S, Tinglev (DK)

(72) Inventors: Gert Jorgensen, Grasten (DK); Lars Lubker, Haderslev (DK)

(73) Assignee: MAERSK CONTAINER INDUSTRY A/S, Tinglev (DK)

( * ) Notice: Subject to any disclaimer, the term of this patent is extended or adjusted under 35 U.S.C. 154(b) by 0 days.

(21) Appl. No.: 15/903,568

(22) Filed: Feb. 23, 2018

(65) Prior Publication Data

US 2018/0178975 A1 Jun. 28, 2018

Related U.S. Application Data

(63) Continuation of application No. 15/037,255, filed as application No. PCT/EP2014/074259 on Nov. 11, 2014, now Pat. No. 10,099,852.

(30) Foreign Application Priority Data

Nov. 18, 2013 (DK) ..... 2013 70699

(51) Int. Cl.
*B65D 90/02* (2019.01)
*B65D 90/00* (2006.01)

(52) U.S. Cl.
CPC ..... *B65D 90/027* (2013.01); *B65D 90/006* (2013.01)

(58) Field of Classification Search
CPC .... B65D 90/00; B65D 90/027; B65D 90/008; B65D 90/02; B65D 90/021; B65D 90/022; B65D 90/023; B65D 90/04; B65D 1/44; B65D 5/5054; B65D 7/46; B65D 65/403;
(Continued)

(56) References Cited

U.S. PATENT DOCUMENTS 3,834,575 A 9/1974 Carr
4,854,460 A 8/1989 Josephs
5,253,918 A 10/1993 Wood et al.
(Continued)

FOREIGN PATENT DOCUMENTS

CN 201183656 Y 1/2009
DE 4342366 A1 7/1994
(Continued)

OTHER PUBLICATIONS

European Search Report for EP 17207051, completed Jan. 22, 2018.
(Continued)

*Primary Examiner* — Kareen K Thomas
(74) *Attorney, Agent, or Firm* — Brinks Gilson & Lione

(57) ABSTRACT

A shipping container includes a pair of side walls, a rear end, a front end, a roof, and a base frame. The base frame includes two longitudinal bottom side rails and a plurality of parallel bottom cross members on which a corrugated steel floor is resting and to which the cross members are secured. The steel floor includes a plurality of floor slabs and the steel floor includes corrugations. The corrugations having ridges and grooves running in a lengthwise direction of the container towards an opening for loading and unloading goods to be shipped or stored in the container. Attachments for lashing are installed in the corrugated steel floor.

19 Claims, 9 Drawing Sheets

(58) Field of Classification Search
CPC ..... B65D 65/406; B65D 81/386; B65D 2501/24815
See application file for complete search history.

(56) References Cited

U.S. PATENT DOCUMENTS

| | | | | |
|---|---|---|---|---|
| 5,398,832 | A | 3/1995 | Clive-Smith | |
| 6,182,411 | B1 | 2/2001 | Ganser et al. | |
| 7,975,935 | B2 * | 7/2011 | Matheis, Jr. | B05B 7/24 118/300 |
| 2001/0031185 | A1 | 10/2001 | Swensen | |
| 2005/0029256 | A1 * | 2/2005 | Chen | B65D 88/121 220/1.5 |
| 2005/0152774 | A1 | 7/2005 | Pierce et al. | |
| 2010/0135742 | A1 * | 6/2010 | Sain | B65D 88/12 410/46 |
| 2011/0192566 | A1 | 8/2011 | Marshall | |
| 2012/0301696 | A1 | 11/2012 | Watanabe et al. | |
| 2012/0306252 | A1 | 12/2012 | Ligonniere et al. | |

FOREIGN PATENT DOCUMENTS

| | | | |
|---|---|---|---|
| EP | 1193124 | A2 | 4/2002 |
| GB | 976515 | A | 11/1964 |
| GB | 2200600 | A | 8/1988 |
| GB | 2377924 | A | 1/2003 |
| GB | 2406560 | A | 4/2005 |
| JP | 2003276791 | A | 10/2003 |

OTHER PUBLICATIONS

Office Action for Chinese Application No. 201711370908.1, dated Oct. 23, 2018.
International Search Report and Written Opinion for PCT/EP2014/074259, dated Feb. 6, 2015.
International Preliminary Report on Patentability for PCT/EP2014/074259, mailed Completed Jan. 1, 2016.

* cited by examiner

CORRUGATED STEEL FLOOR IN A SHIPPING CONTAINER

RELATED APPLICATIONS

This application is a continuation under 35 U.S.C. § 120 of U.S. application Ser. No. 15/037,255, filed May 17, 2016, which claims the benefit under 35 U.S.C. § 371 of the filing date of International Patent Application No. PCT/EP2014/074259, having an international filing date of Nov. 11, 2014, which claims priority to Danish Application No. DK PA201370699, filed Nov. 18, 2013, the contents of all of which are incorporated herein by reference in their entirety.

BACKGROUND

Field

The invention relates to an element for a corrugated steel floor e.g. in a shipping container, which steel floor is positioned with corrugations running towards an opening for loading and unloading goods to be shipped or stored in the container.

Description of Related Art

A shipping container usually comprises a pair of side walls, a rear end, a front end, a roof, a floor and a base frame. The base frame comprises two longitudinal bottom side rails and a plurality of parallel bottom cross members on which the floor is resting and to which cross members the floor is secured by fastening means.

In GB 2 406 560 is described a shipping container having a corrugated steel floor, which steel floor is welded to cross beams or cross members on which the floor is supported. The welding is performed in such a way that the welding seam is positioned under the corrugated floor.

Some disadvantages relating to such a solution to be mentioned are the difficulty in mounting the floor within the container. The floor must be assembled to the cross members before entering the container or the floor must be welded to the cross members while a welder is placed in an upright position for example in a pit beneath the container or the container is elevated to make room for a person standing or sitting under the container.

Further it is not desirable to weld on a steel floor applied with a kind of surface treatment to prolong the life of the floor. Such a procedure will burn off the surface treatment being paintwork, galvanisation or electroplating.

If welded to cross members the surface treatment of cross members is damaged as well. If postponing the surface treatment till after welding there will be overlapping areas between cross members and floor where no coating is applied. Further the assembled floor section will be difficult to handle if the assembled floor section should be provided with surface treatment.

Another disadvantage relating to known corrugated steel floors is that to ensure proper handling of pallets or other kind of goods to be positioned by pallet trucks or pallet jacks, "valleys" formed by grooves between ridges in the corrugated floor are filled by stuffing, which stuffing is dimensioned to ensure a level floor with no difference in height. Hereby wheels from pallet trucks or pallet jacks can roll relatively smooth on the floor.

Several known corrugated floors making use of stuffing to fill up the grooves between the ridges are manufactured with wide ridges to bring down the weight of the corrugated steel floor.

The stuffing can be made of wood, plastics or another preferably light material.

In combination with the corrugated steel floor, a thin plate can be paved on the corrugated steel floor. The thin plate may be made of thin wooden plate, composite plate or steel plate. Non-metallic stuffing may be filled within all the grooves of the corrugated steel floor in this embodiment too.

Such a floor is known from CN 201 183 656 Y.

Further a corrugated steel floor is often placed within a container in such a way that the ridges and grooves are positioned in a lengthwise direction of the container, in such a way that the ridges and grooves points towards a door or opening of the container. This is relevant for the possibility of emptying the grooves of the container floor from water or dirt and other such unwanted elements without need for special designed channels, grooves or pipes for emptying the grooves of the corrugations. Such special designed channels, grooves or pipes for emptying the grooves of the corrugations will be very difficult to clean and will most certainly be blocked by dirt or residues, but will be necessary in case the corrugations are positioned crosswise in the container.

It is known to have corrugated floors within a container where the top of the ridges are level with a door sill. This requires that the above mentioned water, dirt or other residues can be led to a transition between the corrugated floor and the door sill where water, dirt or other residues can be led out of the container. This can be done by manually sweeping the transition with a broom or another suitable tool.

From US 2005/152774 A1 is known a floor made of overlapping floor elements, which elements are placed in relation to each other in such a way that a channel is formed enclosed completely by the overlapping elements.

The vertical part of the elements forms a vertical support for a horizontal part of the elements and the elements are placed on a subfloor. Grooves are provided to make enough space for prongs of a fork lift for placing goods directly on the floor in stead of placing the goods on pallets.

Further the channels formed by the overlapping elements of US 2005/152774 A1 will create relatively large cavities which are very difficult to keep clean and can therefore be a source to corrosion and contamination of sensible cargo.

SUMMARY

The object of the invention is to provide a corrugated steel floor making it possible that wheels from pallet trucks, pallet jacks, sack trolleys or similar equipment can roll relatively smooth on a corrugated steel floor without need for stuffing to fill up the grooves between the ridges and without need for an additional layer to be paved upon the corrugated steel floor.

By a corrugated steel floor according to the invention the above disadvantages are avoided by having a corrugated steel floor where a distance between the ridges measured from a substantial vertical one side of a groove to a substantial vertical other side of the groove may be shorter than or equal to 40 mm.

Hereby is achieved that wheels from pallet trucks, pallet jacks, sack trolleys or similar equipment can roll relatively smooth on a corrugated steel floor without need for stuffing to fill up the grooves between the ridges.

By substantial vertical is meant between 85 and 95 degrees in relation to a horizontal direction.

According to an aspect of the solution the grooves of the corrugations are flush with or placed on a door sill, making it possible to effectively emptying the grooves from water, dirt or other residues.

In another aspect the floor is assembled of a plurality of floor slabs making it possible to build up a floor of elements within the container.

In another aspect a length of a first side of a floor slab is shorter than a length of a second side of the floor slab, which difference corresponds to a material thickness of the floor slab, making it possible to join two floor slabs with an overlap and still have a level topside of the ridges relative to each other.

In another aspect the corrugated floor at an end of the floor pointing towards the opening for loading and unloading goods to be shipped or stored in the container, the ridges of the corrugations are provided with a ramp, which ramp extends from a ridge to a level corresponding to the grooves.

Hereby is facilitated easy and convenient access to the interior of the container for pallet trucks, pallet jacks, sack trolleys or similar equipment without need for overcoming a high sharp edge.

Further is achieved that the ramp enforces the end of the ridges, preventing the corrugation from being flattened due to the weight from equipment loading and unloading the container.

In another aspect the floor slabs are coated before placing the slabs in the container.

In another aspect the floor slabs are galvanized.

In another aspect the floor slabs are coated with a corrosion protected layer.

In another aspect the floor slabs are coated with powder paint.

In another aspect the floor slabs are fastened to a number of underlying cross members by fastening screws.

In another aspect the floor slabs are fastened to a number of underlying cross members by rivets.

In another aspect the floor slabs are fastened to a number of underlying cross members by mechanical fastening means such as adhesive, clamping, slot and groove or other suitable positive-fit connections.

These aspects relating to surface treatment of the floor slabs ensures a longer lifetime to the floor slabs.

The floor slabs can be made from high strength steel. As an example HTS high tensile steel can be used for manufacturing of the floor slabs. When using a steel type with higher strength, the floor slabs can be made of less material thickness and thereby the overall weight for the floor is reduced.

Further fewer cross members are necessary, which leads to further weight reduction.

In containers with traditional plywood floors, securing of cargo, also called lashing, is accommodated by lashing rods/rings along bottom/top side rail, corner posts and headers. In case of special cargo which require extra lashing, the plywood flooring can serve as mean for nailing in various combinations and patterns.

In order to facilitate positioning and securing load or cargo within the container, different embodiments of attachment means for lashing can be provided. The purpose of the attachment means for lashing is to provide a fixed point for tying a rope, strap or similar fastening means holding load or cargo in a secured position to avoid damage on the cargo, other cargo shipped in the container or to the container itself.

Given the nature of a corrugated steel floor, lashing by nailing into the floor is not an option. However, in order to accommodate potential extra lashing requirements the corrugated steel floor can be provided with alternatives to traditional lashing to the floor.

Attachment means for lashing can be installed by attachment of rods, brackets or by other mechanical means in random positions in the corrugated floor in the container. It is possible to provide the floor with a combination of the above types of such attachment means for lashing.

Further support blocks or chocks for stabilising the lashing of the cargo can be provided with ridges and grooves on their underside, which ridges and grooves corresponds to engagement with the corrugations in the floor.

Another aspect can be a corrugated steel floor for a shipping container, which steel floor is assembled of a plurality of floor slabs and which steel floor is positioned with corrugations comprising a number of ridges and grooves running towards an opening for loading and unloading goods to be shipped or stored in the container, where a distance between the ridges 6 measured from a substantial vertical one side 8 of a groove 7 to a substantial vertical other side 9 of the groove 7 is shorter than or equal to 40 mm.

Another aspect can be a floor according to the first aspect where a distance between the ridges 6 measured from a substantial vertical one side 8 of a groove 7 to a substantial vertical other side 9 of the groove 7 is shorter than or equal to 35 mm.

Another aspect can be a floor according to the first aspect, where a distance between the ridges 6 measured from a substantial vertical one side 8 of a groove 7 to a substantial vertical other side 9 of the groove 7 is shorter than or equal to 32.5 mm.

Another aspect can be a floor according to the first aspect, where the bottom of the grooves 7 of the corrugations are flush with or placed on a door sill 14.

Another aspect can be a floor according to the first aspect, where a height of a first side 11 of a floor slab 10 is less than a height of a second side 12 of the floor slab 10, which difference corresponds to a material thickness of the floor slab 10.

Another aspect can be a floor according to the first aspect, that at an end of the floor 1 pointing towards the opening 21 for loading and unloading goods to be shipped or stored in the container 20, the ridges 6 of the corrugations are provided with a ramp 13, which ramp 13 inclines from a ridge 6 to a level corresponding to the grooves 7.

Another aspect can be a floor according to the first aspect, that at an end of the floor 1 pointing towards the opening 21 for loading and unloading goods to be shipped or stored in the container 20, the ridges 6 of the corrugations are positioned abutting a ramp 13, which ramp 13 inclines from a ridge 6 to a level corresponding to the grooves 7.

Another aspect can be a floor according to the first aspect, where the floor slabs 10 are coated.

Another aspect can be a floor according to the first aspect, where the floor slabs 10 are galvanized.

Another aspect can be a floor according to the first aspect, where the floor slabs 10 are coated with a corrosion protected layer.

Another aspect can be a floor according to the first aspect, where the floor slabs 10 are coated with powder paint.

Another aspect can be a floor according to the first aspect, where the floor slabs 10 are fastened to a number of underlying cross members 4 by fastening screws 5.

Another aspect can be a floor according to the first aspect, where the floor slabs 10 are fastened to a number of underlying cross members 4 by rivets 5.

Another aspect can be a floor according to the first aspect, where the floor slabs 10 are fastened to a number of underlying cross members 4 by mechanical fastening means 5.

Further embodiments and advantages are disclosed below in the description and in the claims.

BRIEF DESCRIPTION OF THE DRAWINGS

The invention will now be described more fully below, by way of example only, with reference to the accompanying drawings, in which.

DETAILED DESCRIPTION

Figure 1:
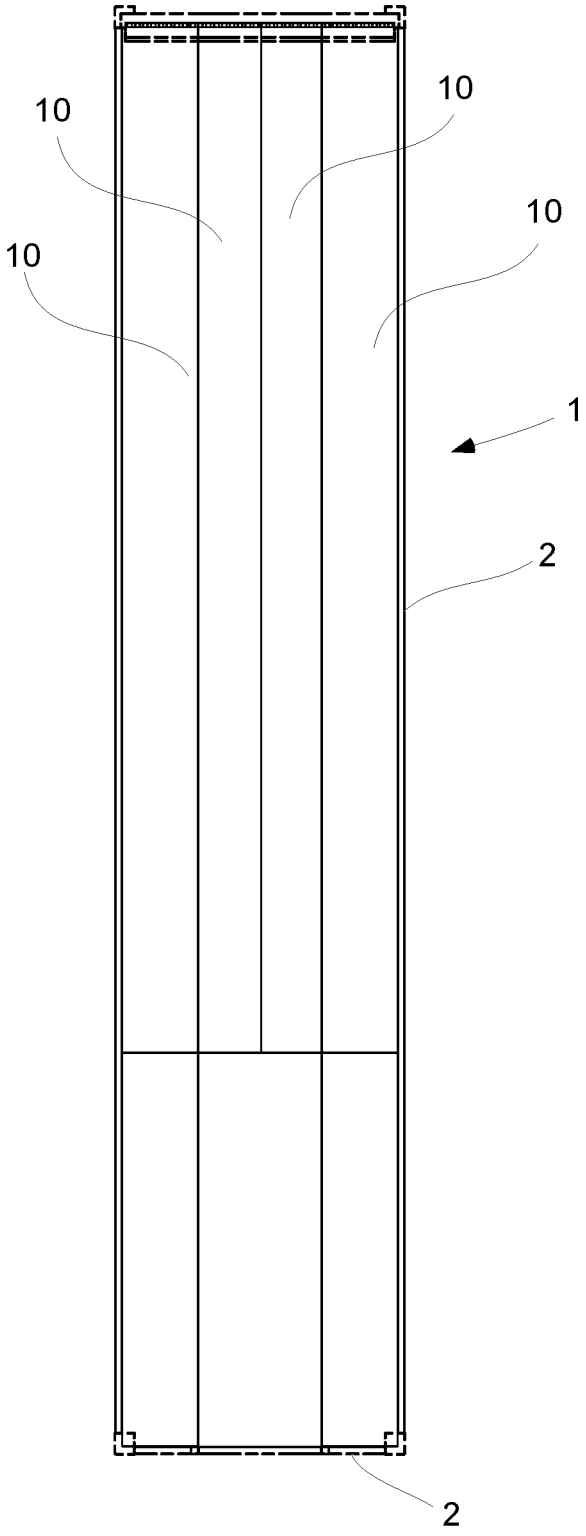
FIG. 1 shows schematically a container floor seen from above, inside the container.
Figure 2:
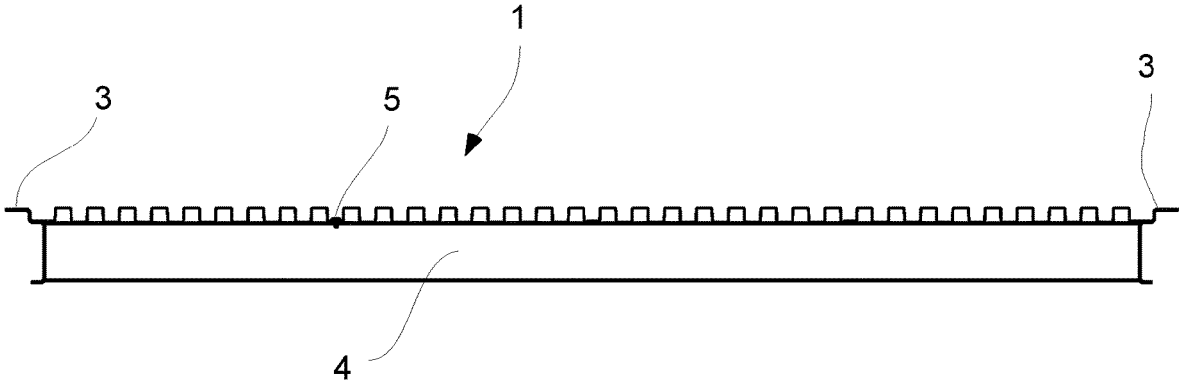
FIG. 2 shows schematically a corrugated floor for a container.
Figure 3:
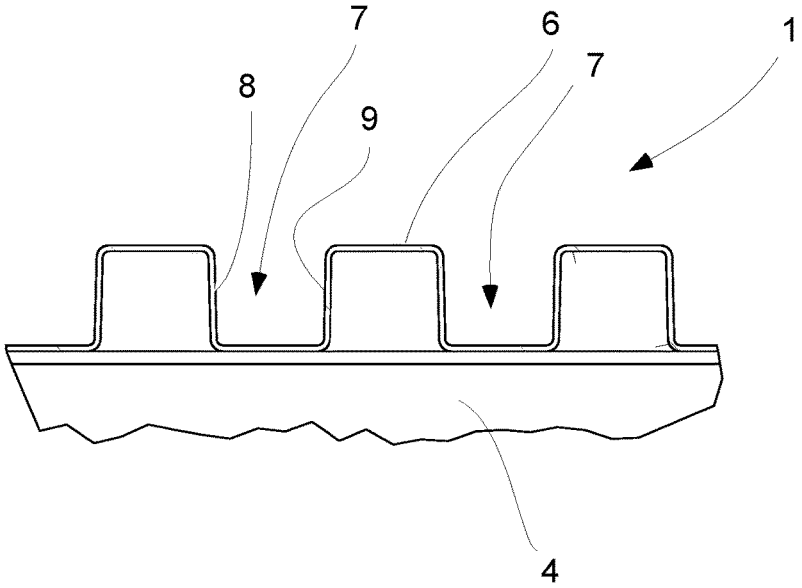
FIG. 3 shows schematically a section of a corrugated floor for a container.
Figure 4:
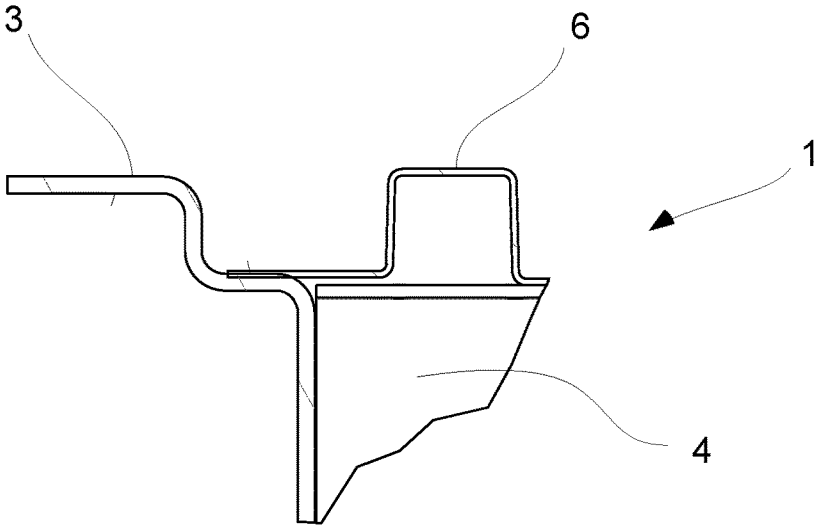
FIG. 4 shows schematically a section of a transition between the corrugated floor and a bottom side rail.
Figure 5:
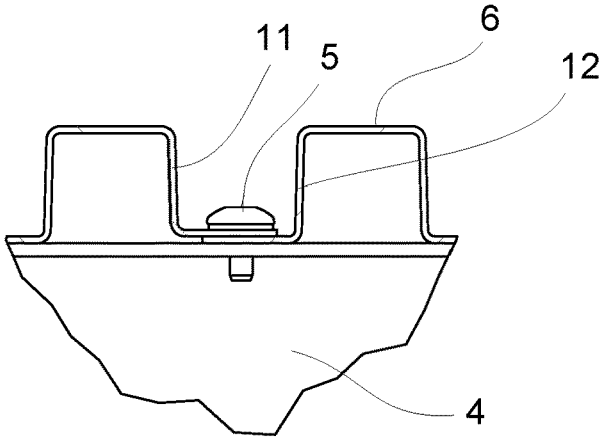
FIG. 5 shows schematically a section with a joining of two floor slabs.
Figure 6:
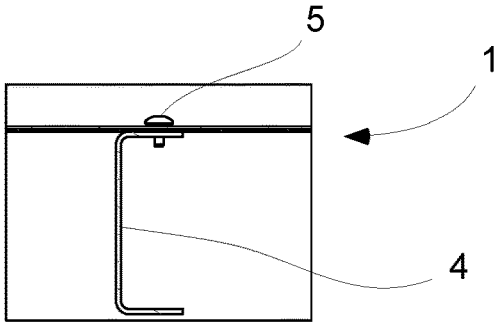
FIG. 6 shows schematically a side view of a floor slab joined to a cross beam.
Figure 7:
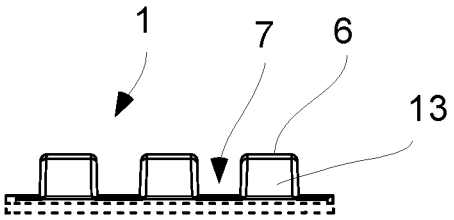
FIG. 7 shows schematically a section of a floor slab seen from an end with a ramp.
Figure 8:
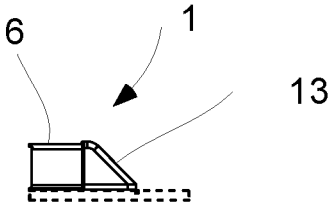
FIG. 8 shows schematically the section from FIG. 7 seen from a side.
Figure 9:
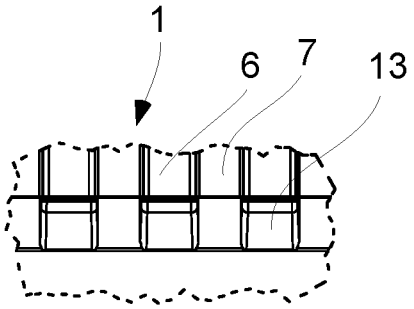
FIG. 9 shows schematically the section from FIG. 7 seen from above.
Figure 10:
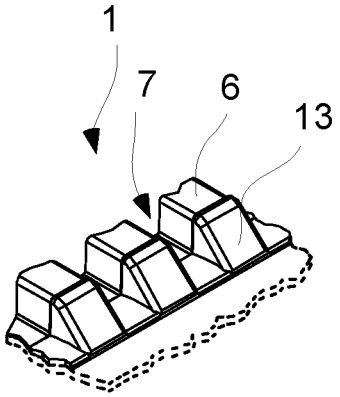
FIG. 10 shows schematically the section from FIGS. 7 to 9 in a perspective view.
Figure 11:
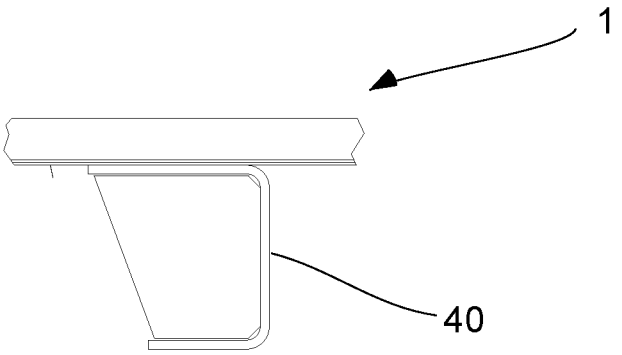
FIG. 11 shows schematically a section of a floor slab placed on a cross member of heavy dimension.
Figure 12:
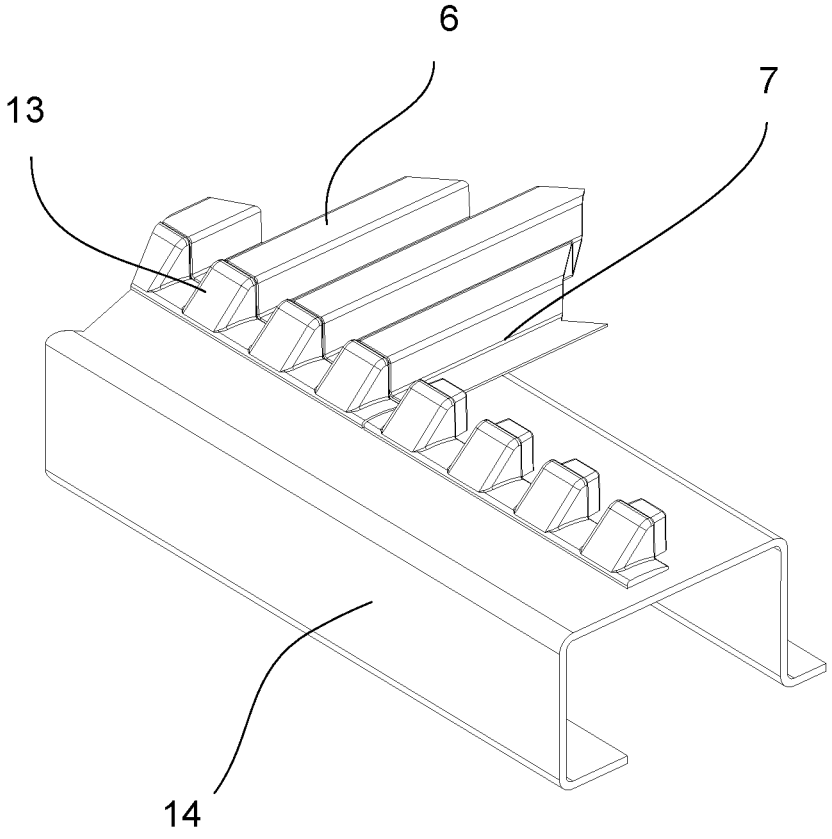
FIG. 12 shows schematically a section of a door sill provided with ramps and a floor slab abutting the door sill and ramps.
Figure 13:
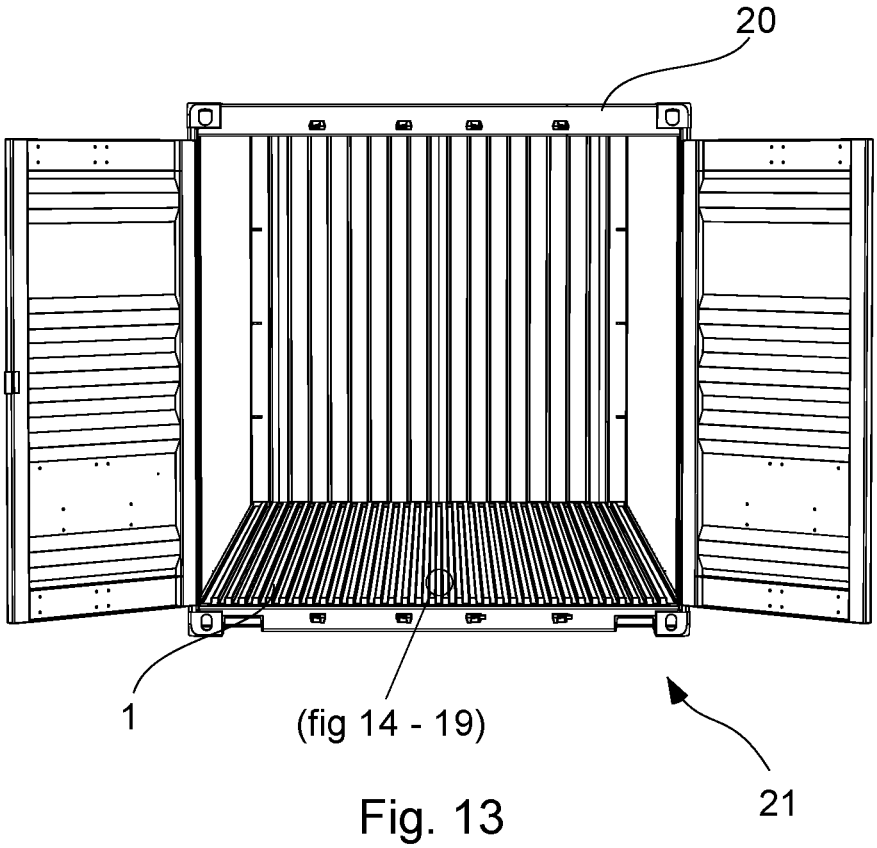
FIG. 13 shows schematically a container with open doors, showing an example of a position for attachment means for lashing.

Now convenient embodiments of the invention will be described.

A shipping container 20 usually comprises a pair of side walls, a rear end, a front end, a roof, a floor 1 and a base frame 2. The base frame 2 comprises two longitudinal bottom side rails 3 and a plurality of parallel bottom cross members 4 on which the floor 1 is resting and to which cross members 4 the floor 1 is secured by fastening means 5. The container is provided with an opening 21 for loading and unloading goods to be shipped or stored in the container 20.

The steel floor 1 is positioned with corrugations comprising a number of ridges 6 and grooves 7 running towards an opening for loading and unloading goods to be shipped or stored in the container 20.

The purpose of the floor 1 is to support items (not shown) to be shipped within the container 20 and to form a sufficient base for equipment handling the items when loading and unloading the container 20. Such equipment can for example be a pallet truck or a pallet jack (not shown), but common to such equipment is that the equipment, which is most often provided with wheels, is intended to roll on a stable surface within the container 20.

When using a corrugated steel floor 1 in a container 20, which corrugated steel floor 1 comprises a number of ridges 6 and grooves 7, the grooves 7 are usually filled with stuffing making it possible that wheels from pallet trucks, pallet jacks, sack trolleys or similar equipment can roll relatively smooth on a corrugated steel floor.

The corrugated steel floor according to the invention is dimensioned in such a way that it is not necessary to make use of stuffing in the grooves 7. This is achieved with a corrugated steel floor 1, where a distance between the ridges 6 measured from a substantial vertical one side 8 of a groove 7 to a substantial vertical other side 9 of the groove is shorter than or equal to 40 mm.

In an alternative embodiment the distance between the ridges 6 measured from a substantial vertical one side 8 of a groove 7 to a substantial vertical other side 9 of the groove is shorter than or equal to 35 mm.

In yet an alternative embodiment the distance between the ridges 6 measured from a substantial vertical one side 8 of a groove 7 to a substantial vertical other side 9 of the groove is shorter than or equal to 32.5 mm.

Hereby is achieved that wheels from pallet trucks, pallet jacks, sack trolleys or similar equipment can roll relatively smooth on a corrugated steel floor 1 without need for stuffing to fill up the grooves 7 between the ridges 6.

According to an aspect of the solution the grooves 7 of the corrugations are flush with or placed on a door sill 14, making it possible to effectively emptying the grooves 7 from water, dirt or other residues.

In another aspect the floor 1 is assembled of a plurality of floor slabs 10 making it possible to build up a floor 1 of elements within the container 20.

In another aspect a height of a first side 11 of a floor slab 10 is less than a height of a second side 12 of the floor slab 10, which difference corresponds to a material thickness of the floor slab 10, making it possible to join two floor slabs 10 with an overlap and still have a level topside of the ridges 6 relative to each other.

In another aspect the corrugated floor 1 at an end of the floor pointing towards the opening for loading and unloading goods to be shipped or stored in the container 20, the ridges 6 of the corrugations are provided with a ramp 13, which ramp 13 inclines from a ridge 6 to a level corresponding to the grooves 7.

Hereby is facilitated easy and convenient access to the interior of the container 20 for pallet trucks, pallet jacks, sack trolleys or similar equipment without need for overcoming a high sharp edge.

Further is achieved that the ramp 13 enforces the end of the ridges 6, preventing the corrugation from being flattened due to the weight from equipment loading and unloading the container 20.

In another aspect the floor slabs 10 are coated before placing the slabs 10 in the container 20.

In another aspect the floor slabs 10 are galvanized.

In another aspect the floor slabs 10 are coated with a corrosion protected layer.

In another aspect the floor slabs 10 are coated with powder paint.

These aspects relating to surface treatment of the floor slabs 10 ensures a longer lifetime to the floor slabs 10.

The floor 1 can be assembled by floor slabs 10 extending over the entire length of the container 20.

Floor slabs 10 can also be dimensioned to cover a part of the length, but floor slabs 10 extending substantially over the entire length of the container 20 is preferred.

By assembling the floor 1 by floor slabs 10 fastened by screws, rivets or other mechanical fastening means 5 to the cross members 4, it is possible to provide the floor slabs 10 with a surface treatment, which is not damaged by welding as if the floor was welded to the cross members 4. Also damage to cross member surface treatment due to welding is avoided.

The floor 1 or floor slabs 10 can be fastened to a number of underlying cross members 4 by mechanical fastening means such as adhesive, clamping, slot and groove etc. The slot and groove can be realised by a raised tongue fitting into a slit positioned on a floor slab 10 and to a cross member 4 respectively or a similar positive-fit connection. When floor and cross members is translated relative to each other the tongues are engaging with the slits and a few screws, rivets or other mechanical removable fastening means can hold the floor and secure against relative horizontal movement between floor and cross member while the positive-fit connection prevents relative vertical movement between floor and cross member.

Further it is easy to replace one or more floor slabs 10 if a part of the floor 1 should be damaged.

In another aspect the ramps 13 is secured to the door sill 14 in such a way that one end of the floor slabs 10 can be positioned at the end of the floor 1 pointing towards the opening for loading and unloading goods to be shipped or stored in the container 20, where the ridges 6 of the corrugations are positioned abutting the ramp 13, which ramp 13 inclines from a ridge 6 to a level corresponding to the grooves 7 and thereby forming a floor, where the ridges 6 of the floor slabs are substantially flush with ridges of the ramps 13.

In an embodiment the ramps 13 are secured to the door sill 14 by welding. Here the part of the ramps pointing towards the opening of the container 20 is welded along a majority of the entire length of the ramps, preferably along the entire length.

On the rear side of the ramps 13 or the side pointing away from the opening 21 of the container 20, the ramps 13 are welded in spots situated behind the tops or ridges 6 of the ramps 13. Thereby the welding seam will not block for positioning the lower part being the grooves 7 of the corrugated floor slabs 10 on the door sill 14 abutting the ramps 13.

In an alternative embodiment a floor slab 10 of the corrugated floor 1, at the end of the floor 1 pointing towards the opening 21 for loading and unloading goods to be shipped or stored in the container 20, is provided with ramps 13. Hereby it is easy to see if the floor slab 10 is positioned in the right direction thereby ensuring that the overlap will be placed correctly so that the assembled floor 1 will have the same height and the upper side of the ridges 6 of the floor 1 is level.

In case it is necessary to have one or more cross beams or cross members 40 of a heavier dimension than the rest of the cross members 4, such cross members 40 are positioned with their upper surfaces substantially flush with the rest of the cross members 4 thereby providing a plane support for the floor 1 and making it possible that the corrugations can run continuously from one end of the container 20 to the other end of the container 20.

In an advantageous embodiment, the cross members 4, 40 or the floor slabs 10 are arranged in such a way that they are sloping slightly in direction of the opening 21 end of the container 20 to be able to facilitate emptying of the grooves 7 in the corrugated floor slabs 10.

In the end of the floor pointing away from the container opening 21 an area in the middle section or full width can be substituted by a plane surface, level with the upper part of the corrugations—the ridges 6—to make room for reinforcement or other space consuming elements beneath the floor.

The ends of the corrugations of the floor slabs 10 abutting the plane surface are closed in such a way that water or dirt cannot escape from the grooves 7 through openings. The plane surface can be provided with a substantially vertical or downwards slanting edge, forming an end wall in the corrugated floor slab abutting the edge of the plane surface. If the edge is slanting downwards, its profile should correspond to the corrugations of the floor slab 10.

In both ends of the floor, the floor slabs 10 are provided with blocks and/or sealant, filling out gaps between floor slabs 10 and cross members 4, 40, preventing water from entering from below the floor 1. The sealant can be foam, gum or other suitable material.

Also sealant between joining of the floor slabs 10 prevents water from entering the container 20 from below.

In order to facilitate positioning and securing load or cargo within the container 20, different embodiments of attachment means 15 for lashing can be provided. The purpose of the attachment means 15 for lashing is to provide a fixed point for tying a rope, strap or similar fastening means (not shown) holding load or cargo in a secured position to avoid damage on the cargo, other cargo shipped in the container or to the container 20 itself.

Given the nature of a corrugated steel floor 1, lashing by nailing into the floor is not an option. However, in order to accommodate potential extra lashing requirements the corrugated steel floor 1 can be provided with alternatives to traditional lashing to the floor.

Attachment means 15 for lashing can be installed by attachment of rods, brackets or by other mechanical means in random positions in the corrugated floor 1 in the container 20.

Figure 14:
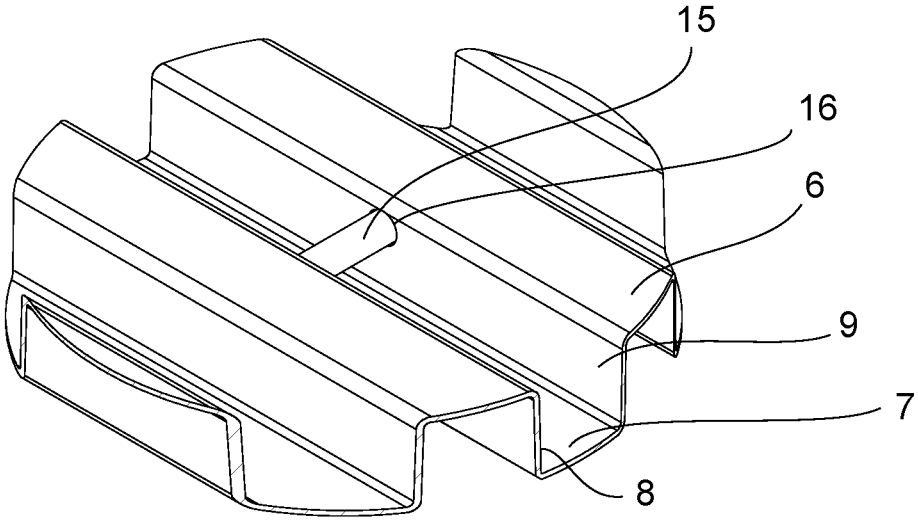
FIG. 14 shows schematically an attachment means for lashing positioned as indicated in FIG. 13.

Attachment means 15 for lashing can be provided by a rod or pin (FIG. 14) fixed in holes 16 in the substantial vertical sides 8, 9 of the ridges 6 in the corrugated floor 1. The rod or pin can be fixed by welding, soldering, brazing, gluing or other known fixing methods, It is possible to fix the rod in the holes in the ridges 6 before the floor slabs 10 are positioned in the container 20, which makes it possible to coat or provide the floor slab 10 with a surface treatment preventing corrosion after fixing the rod to the floor slab 10. In an alternative, the rod or pin can be positioned in the holes in the substantial vertical sides of the ridges 6 and held in place by a foam block, which foam block is shaped to fit in the underside of a ridge. Thereby the foam block acts both as a member holding the rod or pin in place in the floor and as a sealing means preventing water from entering the container from the underside. Other suitable and similar resilient and sealing materials can be used.

Figure 15:
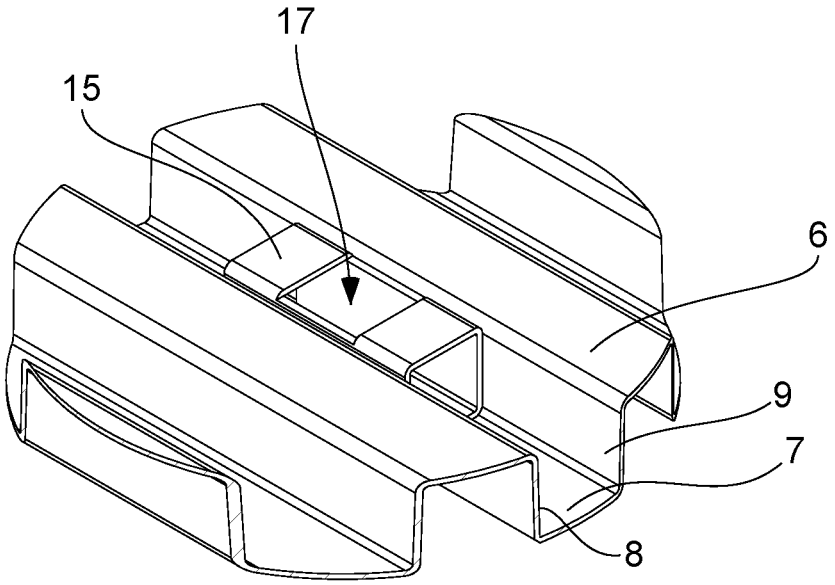
FIG. 15 shows schematically an alternative attachment means for lashing positioned as indicated in FIG. 13.

Attachment means 15 for lashing can be provided by a piece of a square or rectangular tube in which an opening 17 is cut in a middle portion of an upper surface of the tube (FIG. 15). The tube is positioned in a groove 7 between two ridges 6 and the tube can be fixed by welding, soldering, brazing, gluing or other known fixing methods, It is possible to fix the tube in the groove 7 before the floor slabs 10 are positioned in the container 20, which makes it possible to coat or provide the floor slab 10 with a surface treatment preventing corrosion after fixing the rod to the floor slab 10. The tube can also be fixed with the floor slab 10 positioned in the container 20.

Figure 16:
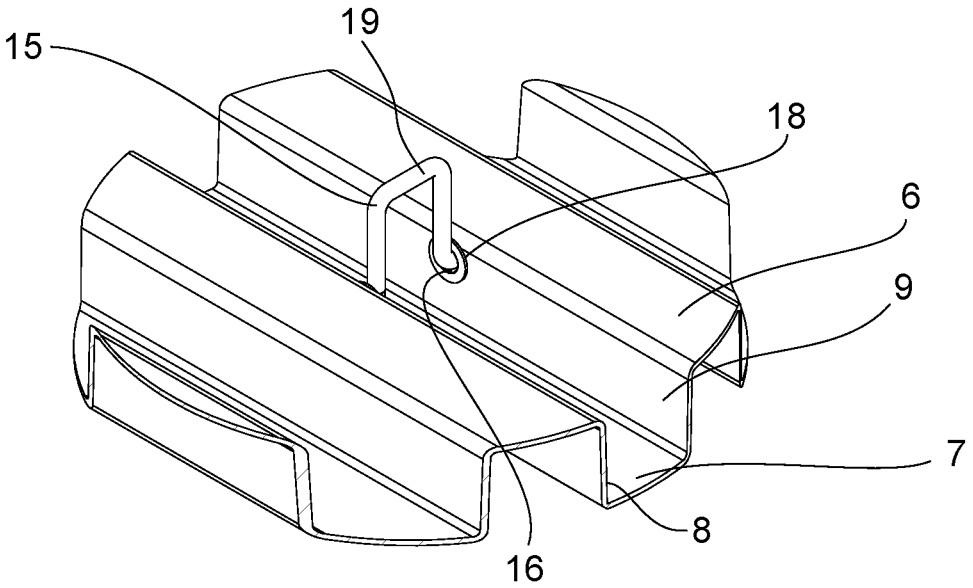
FIG. 16 shows schematically an alternative attachment means for lashing positioned as indicated in FIG. 13.

Attachment means 15 for lashing (FIG. 16) can be provided by a bracket having two parallel portions, which parallel portions are connected in one end by a connection portion 19 and at the opposite free end the parallel portions are bended into an outgoing direction in order to engage with holes 16 in the substantial vertical sides 8, 9 of a ridge 6 in the corrugated floor 1.

Figure 17:
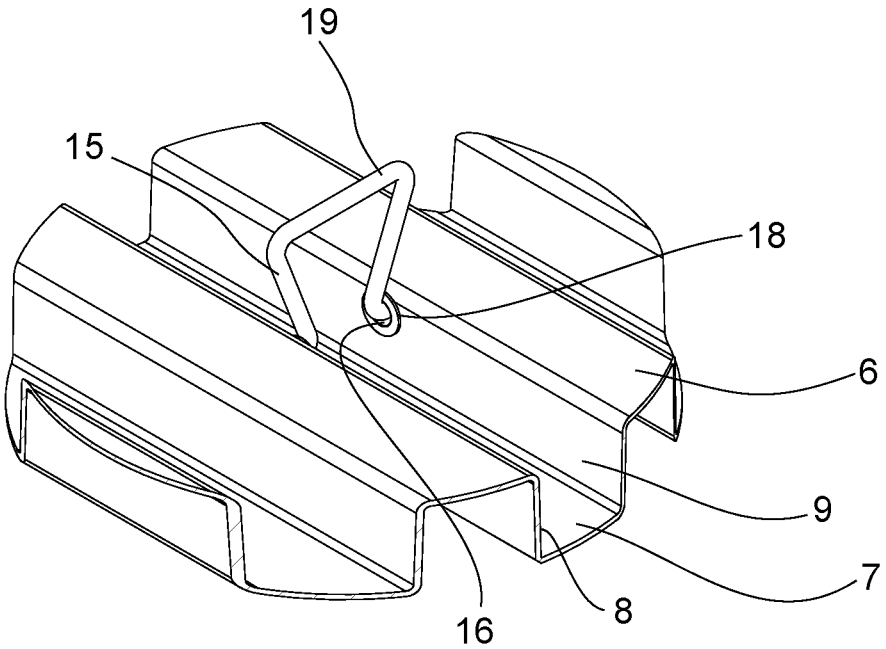
FIG. 17 shows schematically an alternative attachment means for lashing positioned as indicated in FIG. 13.

An alternative bracket for lashing (FIG. 17) can be provided by two converging portions, which portions are connected by a connection portion 19 in the end having the widest distance from each other and at the opposite free end the converging portions are bended into an outgoing direction (FIG. 16) in order to engage with holes 16 in the substantial vertical sides 8, 9 of the ridges 6 in the corrugated floor 1. The connecting portion 19 is preferably longer than the width of the groove 7.

Figure 18:
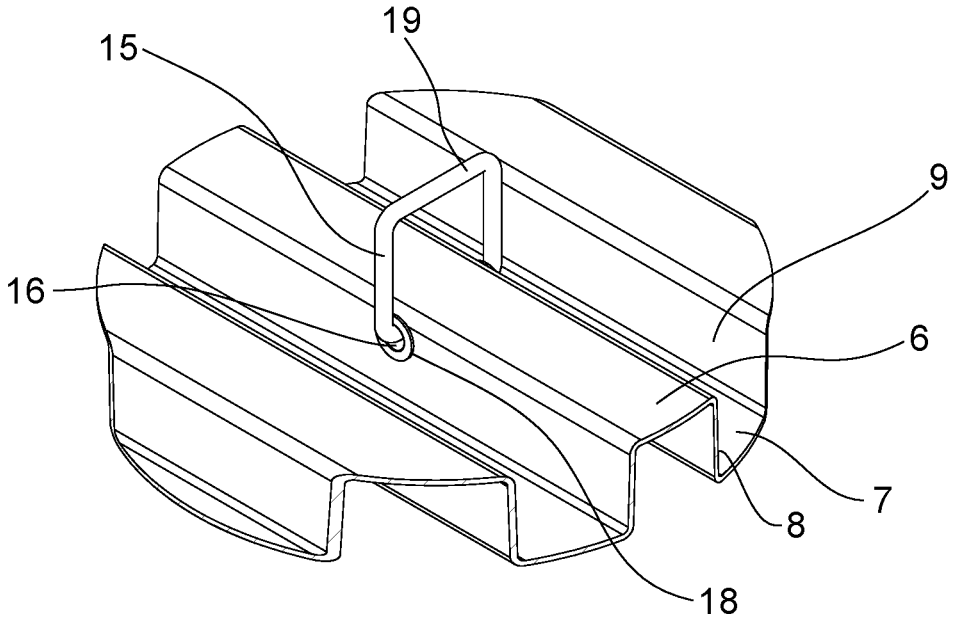
FIG. 18 shows schematically an alternative attachment means for lashing positioned as indicated in FIG. 13.
Figure 19:
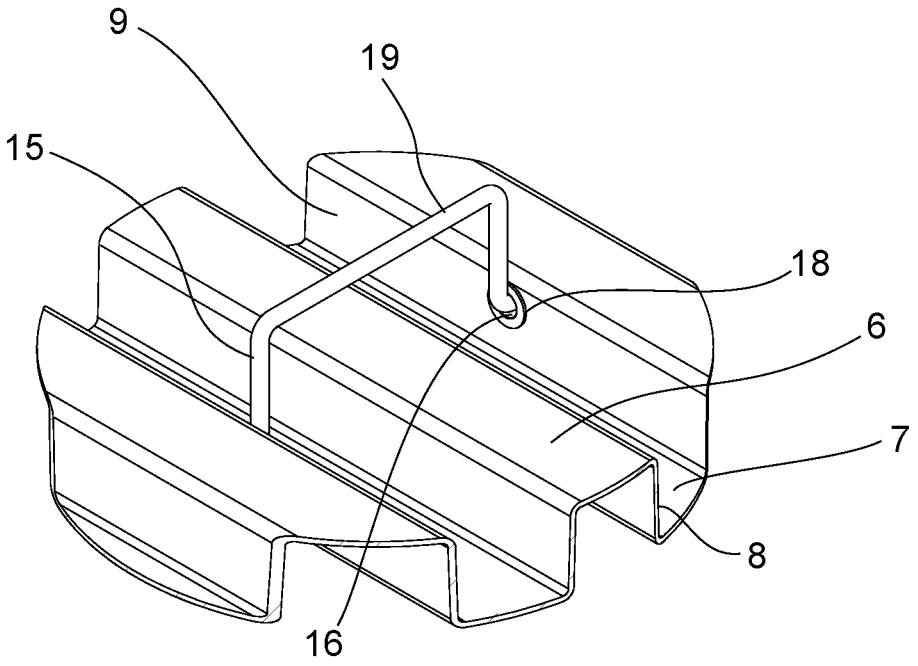
FIG. 19 shows schematically an alternative attachment means for lashing positioned as indicated in FIG. 13.

An alternative bracket for lashing (FIG. 18) can be provided by a bracket having two parallel portions, which parallel portions are connected in one end by a connection portion 19 and at the opposite free end the parallel portions are bended towards each other in an ingoing direction in order to engage with holes 16 in the substantial vertical sides 8, 9 of a ridge 6 in the corrugated floor 1, An alternative bracket for lashing (FIG. 19) can be provided by a bracket having two parallel portions, which parallel portions are connected in one end by a connection portion 19, which connection portion is longer than the width of a groove 7, At the opposite free end the parallel portions are bended into an outgoing direction in order to engage with holes 16 in the substantial vertical sides 8, 9 of a ridge 6 in the corrugated floor 1. Preferably the length of the bracket corresponds to a distance a bit longer than the distance corresponding to the width of two grooves and one ridge in order to let the free ends of the bracket engage in the holes 16 in the substantial vertical sides 8, 9 of ridges 6.

The brackets can be fixed with the floor slab 10 positioned in the container 20.

The holes 16 in the ridges 6 can be made before profiling the floor slab 10 or the holes 16 can be provided after profiling the floor slab 10 before the floor slabs 10 are positioned in the container 20, which makes it possible to coat or provide the floor slab 10 with a surface treatment preventing corrosion after providing the hole 16 in the floor slab 10.

It is also possible to provide the hole after the floor slab 10 is positioned in the container 20 and optionally provide the hole 16 with an after treatment preventing corrosion after providing the hole 16 in the floor slab 10.

To avoid damage to the hole 16, a bushing or reinforcement disc 18 can be inserted in the hole 16, thereby reducing wear from the bracket due to stress caused by the lashed cargo. The bushing or reinforcement disc 18 can also be provided with sealing means preventing water from passing through the hole where the bushing or reinforcement disc 18 is placed in the floor 1.

We claim:

1. A shipping container comprising:

a pair of side walls, a rear end, a front end, a roof; and a base frame, said base frame comprising two longitudinal bottom side rails and a plurality of parallel bottom cross members on which a corrugated steel floor is resting and to which the cross members are secured, wherein the steel floor comprises a plurality of floor slabs and the steel floor comprises corrugations, the corrugations having ridges and grooves running in a lengthwise direction of the container towards an opening for loading and unloading goods to be shipped or stored in the container, wherein attachments for lashing are installed in the corrugated steel floor.

2. The shipping container according to claim 1, wherein the attachments for lashing are within grooves of the corrugations.

3. The shipping container according to claim 2, wherein the attachments for lashing are positioned below an upper side of the ridges.

4. The shipping container according to claim 3, wherein the attachments for lashing are rods or pins extending between the vertical sides of the ridges.

5. The shipping container according to claim 1, wherein the attachments for lashing are rods or pins extending between vertical sides of the ridges.

6. The shipping container according to claim 1, wherein the attachments for lashing is positioned in the grooves and allow emptying of the grooves of the container floor from water or dirt.

7. The shipping container according to claim 6, wherein a bushing and/or a sealing material is inserted in a hole in the steel floor.

8. The shipping container according to claim 1, wherein the attachments comprise two parallel portions connected at one end by a connection portion and an opposite free end the parallel portions are bended to engage with holes in the vertical sides of the ridges.

9. The shipping container according to claim 8, wherein the connection portion is longer than the width of one groove.

10. The shipping container according to claim 1, wherein the attachments comprise two converging portions connected at one end by a connection portion and an opposite free end wherein parallel portions are bent to engage with holes in vertical sides of the ridges.

11. The shipping container according to claim 10, wherein the connection portion is longer than the width of one groove.

12. The shipping container according to claim 11, wherein a bushing and/or a sealing material is inserted in a hole in the steel floor.

13. The shipping container according to claim 1, wherein the attachments are a rectangular or square tube positioned between vertical sides of two ridges.

14. The shipping container according to claim 13, wherein the tube comprises an opening in a middle of an upper surface of the tube.

15. The shipping container according to claim 1, wherein the attachments are fixed to corrugated steel floor with welding, soldering, brazing, or gluing.

16. The shipping container according to claim 1, wherein holes in the floor slabs are provided before placing the slabs in the container.

17. The shipping container according to claim 16, wherein the floor slabs are coated after providing the hole in the floor slab.

18. The shipping container according to claim 17, wherein the coating of the floor slabs comprises galvanizing the floor slab, coating the floor slab with a corrosion protected layer, or coating the floor slab with a powder paint.

19. The shipping container according to claim 1, wherein a distance between the ridges measured from a vertical one side of a groove to a vertical side other side of the groove is less than or equal to 40 mm.

* * * * *